US005973281A

United States Patent [19]

Tsai

[11] Patent Number: 5,973,281

[45] **Date of Patent: *Oct. 26, 1999**

[54] KEY SWITCH ASSEMBLY FOR COMPUTER KEYBOARD

[76] Inventor: Huo-Lu Tsai, No. 126-1, Shiu-Nan Rd., Pei-Tun Dist., Taichung City, Taiwan

[ * ] Notice: This patent is subject to a terminal disclaimer.

[21] Appl. No.: 09/124,628

[22] Filed: Jul. 29, 1998

Related U.S. Application Data

[63] Continuation-in-part of application No. 08/918,048, Aug. 25, 1997, Pat. No. 5,823,324.

[51] Int. Cl.[6] ..... H01H 3/12

[52] U.S. Cl. ..... 200/344

[58] Field of Search ..... 200/344

[56] References Cited

U.S. PATENT DOCUMENTS 5,555,971 9/1996 Takada ..... 200/344

5,823,324 10/1998 Tsai ..... 200/344

*Primary Examiner*—Renee S. Luebke

*Attorney, Agent, or Firm*—Blakely Sokoloff Taylor & Zafman

[57] ABSTRACT

A key switch assembly includes a key cap support with first and second support levers. The first support lever has upper and lower rods, and intermediate circular connecting portions. The circular connecting portions have circumferential edges which form first shoulders that interconnect front sides of the upper and lower rods, and second shoulders that interconnect back sides of the upper and lower rods. The lower rods and upper rods have concave first and second end faces that extend transversely along the circumferential edges. The second support lever has upper and lower arms, and intermediate circular plates. The circular plates have peripheral edges which form third shoulders that interconnect back sides of the upper and lower arms, and fourth shoulders that interconnect front sides of the upper and lower arms. The upper and lower arms have concave third and fourth end faces that extend transversely along the peripheral edges of the circular plates. The first and second shoulders abut slidably against the third and fourth end faces, and the first and second end faces abut slidably against the third and fourth shoulders, thereby coupling rotatably the first and second support levers. A biasing member extends upwardly through the first and second support levers to abut against a key cap.

2 Claims, 4 Drawing Sheets

KEY SWITCH ASSEMBLY FOR COMPUTER KEYBOARD

CROSS-REFERENCE TO RELATED APPLICATION

This application is a continuation-in-part (CIP) of U.S. patent application Ser. No. 08/918,048, filed on Aug. 25, 1997, now U.S. Pat. No. 5,823,324.

BACKGROUND OF THE INVENTION

1. Field of the Invention

The present invention relates to a key switch assembly for a computer keyboard, more particularly to a key switch assembly which includes a key cap support with an enhanced strength and which can be easily assembled.

2. Description of the Related Art

U.S. Pat. No. 5,457,297 discloses a conventional key switch assembly which includes a key cap, a bridging device, a bridging device supporting board, a key base, a membrane circuit and a bottom support board. The bridging device includes first and second rectangular frames pivotally connected together into a crossed form. Each of the first and second rectangular frames comprises two parallel rods and two transverse rods connected between the two parallel rods. The parallel rods of the first rectangular frame have intermediate portions formed with pin holes. The parallel rods of the second rectangular frame have two inward pins inserted respectively and inwardly into the pin holes of the first rectangular frame for coupling pivotally the first and second rectangular frames.

When the key switch assembly is used in a notebook computer, the intermediate portions of the first and second rectangular frames are typically made to have a width of about 1.6 millimeters, while the pin holes and the inward pins have diameters of only about 1 millimeter in order to minimize the height of the key switch assembly. As such, the pins might break or the pin holes might be damaged when a relatively large force is applied on the key cap. Therefore, the strength of the coupling between the first and second rectangular frames is not satisfactory. In addition, during assembly, the parallel rods of the second rectangular frame must be bent away from each other so that the inward pins can be registered with the relatively small pin holes for insertion into the pin holes. Assembly of the bridging device is thus difficult to conduct.

In co-pending U.S. patent application Ser. No. 08/918,048, the Applicant disclosed a key switch assembly with a key cap support which includes first and second support levers coupled rotatably about a pivot axis such that the key switch assembly has an increased coupling strength and which can be easily assembled.

SUMMARY OF THE INVENTION

The main object of the present invention is to provide another key switch assembly which includes a key cap support with an enhanced coupling strength and which can be easily assembled.

Accordingly, the key switch assembly of the present invention includes a base board, a membrane circuit provided on the base board and having an electrical contact, an upright biasing member supported on the membrane circuit, a base plate, a scissors-type key cap support and a key cap.

The base plate is disposed on the membrane circuit and is formed with an opening to permit extension of the biasing member therethrough. The opening has opposite first and second sides. The base plate is further formed with a first slot retainer unit adjacent to the first side of the opening, and a first pivot retainer unit adjacent to the second side of the opening. The key cap support includes first and second support levers with upper and lower portions and intermediate portions that are coupled rotatably about a pivot axis. The lower portion of the first support lever is retained slidably in the first slot retainer unit of the base plate. The lower portion of the second support lever is retained pivotally in the first pivot retainer unit of the base plate. The key cap has a bottom side formed with a second pivot retainer unit for retaining pivotally the upper portion of the first support lever, and a second slot retainer unit for retaining slidably the upper portion of the second support lever.

The first support lever has a generally rectangular frame section with a parallel pair of upper rods that serve as the upper portion of the first support lever and that have front and back sides and lower ends, a parallel pair of lower rods that serve as the lower portion of the first support lever and that have front and back sides and upper ends, and a pair of circular connecting portions that interconnect the lower ends of the upper rods and the upper ends of the lower rods and that serve as the intermediate portion of the first support lever. The front sides of the upper rods protrude forwardly relative to the front sides of the lower rods. The back sides of the lower rods protrude rearwardly relative to the back sides of the upper rods. Each of the circular connecting portions has inner and outer sides, a first circumferential edge section which forms a first shoulder that interconnects the front sides of one of the upper rods and a corresponding one of the lower rods, a second circumferential edge section which is diametrically opposite to the first circumferential edge section and which forms a second shoulder that interconnects the back sides of one of the upper rods and a corresponding one of the lower rods, and a third circumferential edge section between the first and second circumferential edge sections and disposed adjacent to the upper end of a respective one of the lower rods. The upper end of each of the lower rods has a concave first end face which extends transversely along the third circumferential edge section at the inner side of a corresponding one of the circular connecting portions. Each of the circular connecting portions further has a fourth circumferential edge section which is diametrically opposite to the third circumferential edge section and which is disposed adjacent to the lower end of a respective one of the upper rods. The lower end of each of the upper rods has a concave second end face which extends transversely along the fourth circumferential edge section at the inner side of a corresponding one of the circular connecting portions.

The second support lever has a parallel pair of lower arms that serve as the lower portion of the second support lever and that have front and back sides and upper ends, a parallel pair of upper arms that serve as the upper portion of the second support lever and that have front and back sides and lower ends, and a pair of circular plates that interconnect the upper ends of the lower arms and the lower ends of the upper arms and that serve as the intermediate portion of the second support lever. The front sides of the upper arms protrude forwardly relative to the front side of the lower arms. The back sides of the lower arms protrude rearwardly relative to the back side of the upper arms. Each of the circular plates has inner and outer sides, a first peripheral edge section which forms a third shoulder that interconnects the back sides of one of the upper arms and a corresponding one of the lower arms, a second peripheral edge section which is diametrically opposite to the first peripheral edge section and which forms a fourth shoulder that interconnects the front sides of one of the upper arms and a corresponding one of the lower arms, and a third peripheral edge section between the first and second peripheral edge sections and disposed adjacent to the lower end of a respective one of the upper arms. The lower end of each of the upper arms has a concave third end face which extends transversely along the third peripheral edge section at the outer side of a corresponding one of the circular plates. Each of the circular plates further has a fourth peripheral edge section which is diametrically opposite to the third peripheral edge section and which is disposed adjacent to the upper end of a respective one of the lower arms. The upper end of each of the lower arms has a concave fourth end face which extends transversely along the fourth peripheral edge section at the outer side of a corresponding one of the circular plates.

The first and second shoulders of the first support lever abut slidably against the third and fourth end faces of the second support lever, and the first and second end faces of the first support lever abut slidably against the third and fourth shoulders of the second support lever, thereby coupling rotatably the first and second support levers.

The biasing member extends upwardly through the key cap support between the circular connecting portions of the first support lever, and between the circular plates of the second support lever, and has a top end which abuts against the bottom side of the key cap to bias the key cap upwardly away from the base plate. The key cap is depressible to compress the biasing member and enable the membrane circuit to produce an electrical signal.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
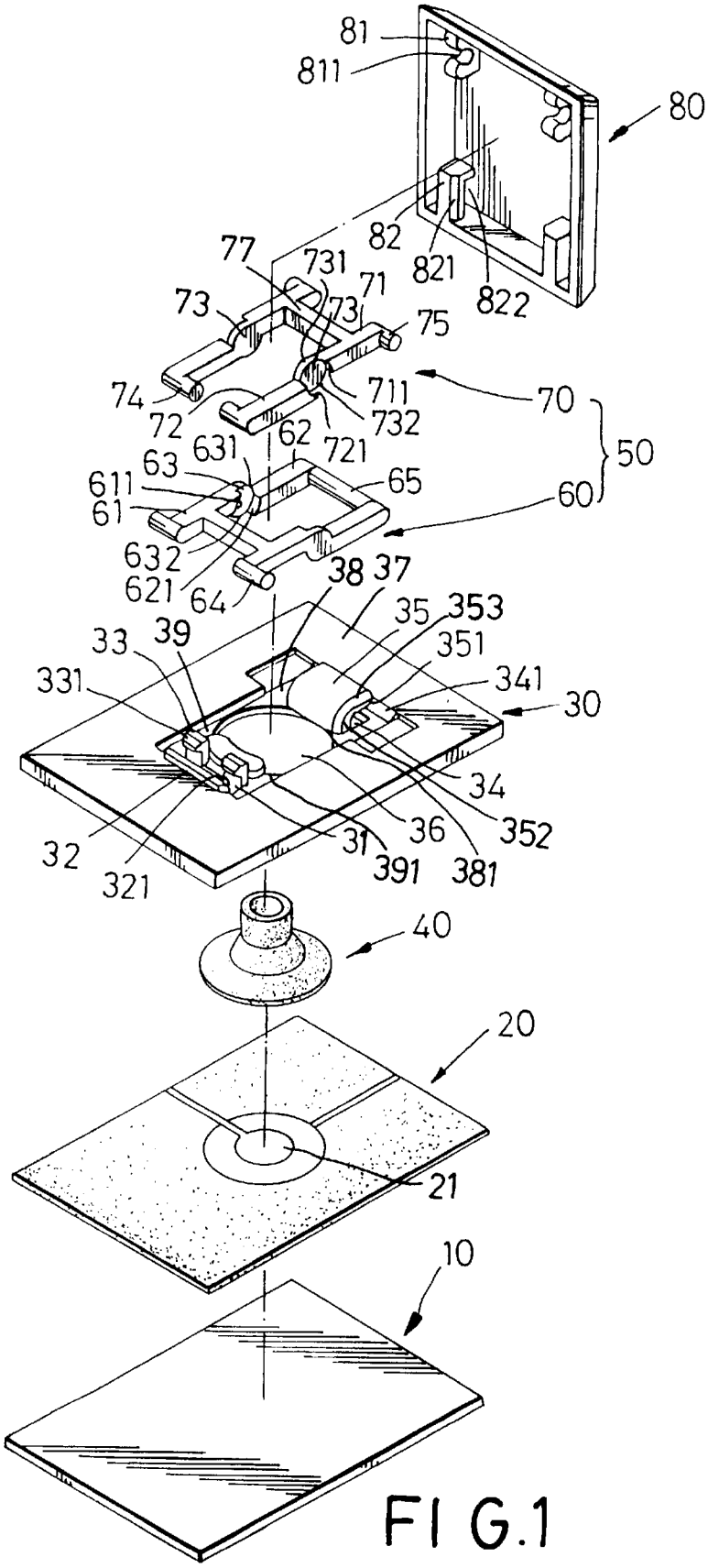
FIG. 1 is an exploded perspective view of a key switch assembly according to a preferred embodiment of the present invention.

Referring to FIG. 1, the key switch assembly according to the preferred embodiment of the present invention is shown to include a base board 10, a membrane circuit 20, an upright biasing member 40, a base plate 30, a scissors-type key cap support 50 and a key cap 80.

The membrane circuit 20 is provided on the base board 10 and has an electrical contact 21.

The biasing member 40, preferably a rubber cone, is supported on the membrane circuit 20.

The base plate 30 is disposed on the membrane circuit 20 and is formed with an opening 36 at a central portion thereof to permit extension of the biasing member 40 therethrough. The base plate 30 includes a hollow rectangular key confining frame portion 37, a first hole defining portion 38 which extends inwardly from the rectangular frame portion 37 and which has a terminating edge 381, and a second hole defining portion 39 which extends inwardly from the frame portion 37 and which has a terminating edge 391. The terminating edges 381, 391 of the first and second hole defining portions 38, 39 are on opposite first and second sides of the opening 36, respectively.

As shown, the first hole defining portion 38 has a top surface that is indented with respect to a top surface of the rectangular frame portion 37, thereby forming a transverse shoulder therebetween. The transverse shoulder has an inclined face 341 which inclines downwardly in a direction away from the rectangular frame portion 37. The base plate 30 further has an L-shaped retaining plate 35 which includes an upright portion 352 that extends upwardly from the first hole defining portion 38, and a horizontal portion 353 that extends from the upright portion 352 in a direction toward the rectangular frame portion 37 and away from the opening 36. The L-shaped retaining plate 35 defines a first slide recess 34 with the first hole defining portion 38, and constitutes a first slot retainer unit in the base plate 30. The horizontal portion 353 has an inclined end face 351 confronting the inclined face 341 and forming an entrance to the first slide recess 34 with the inclined face 341. The second hole defining portion 39 is formed with a transverse guiding strip 32 adjacent to the rectangular frame portion 37, and an opposite pair of cantilevers 33 confronting the guiding strip 32. The guiding strip 32 and the cantilevers 33 cooperatively form two first pivot recesses 31 therebetween, and constitute a first pivot retainer unit in the base plate 30. The guiding strip 32 and the cantilevers 33 have top edges formed with confronting inclined faces 321, 331 which incline downwardly toward one another and which cooperatively form converging entrances 335 (see FIG. 4) to the first pivot recesses 31.

The key cap 80 has a bottom side formed with an aligned pair of slot retainers 82 which define a pair of second slide recesses 822 and which constitute a second slot retainer unit, and an aligned pair of pivot retainers 81 opposite to the slot retainers 82. The pair of pivot retainers 81 form a pair of second pivot recesses 811 and constitute a second pivot retainer unit. As shown, each of the slot retainers 82 has a bottom side formed with an inclined guiding face 821.

Figure 2:
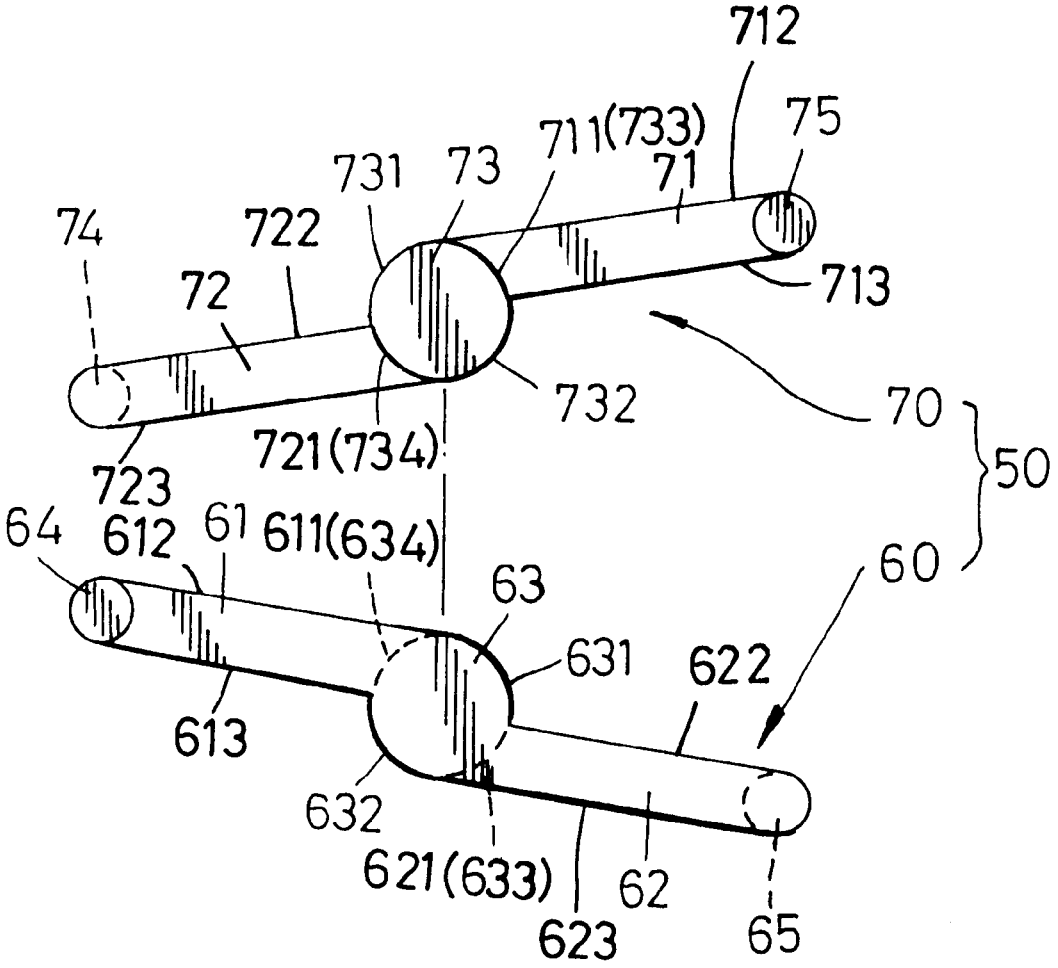
FIG. 2 is a schematic exploded view illustrating a key cap support of the key switch assembly of the preferred embodiment.

Referring to FIGS. 1 and 2, the scissors-type key cap support 50 includes a first support lever 60 and a second support lever 70. The first support lever 60 is formed as a generally rectangular frame with a symmetric construction and includes a parallel pair of upper rods 61 which serve as an upper portion of the first support lever 60, a parallel pair of lower rods 62 which serve as a lower portion of the first support lever 60, and a pair of circular connecting portions 63 which interconnect lower ends of the upper rods 61 and upper ends of the lower rods 62 and which serve as an intermediate portion of the first support lever 60. In this embodiment, each of the circular connecting portions 63 has a thickness equal to one half of the thickness of the upper and lower rods 61, 62. As shown, the circular connecting portions 63 have outer sides that are flush with outer sides of the upper and lower rods 61, 62, and inner sides that are indented relative to inner sides of the upper and lower rods 61, 62. Each of the upper rods 61 has a front side 612 and a back side 613. Each of the lower rods 62 has a front side 622 and a back side 623. The front sides 612 of the upper rods 61 protrude forwardly relative to the front sides 622 of the lower rods 62. The back sides 623 of the lower rods 62 protrude rearwardly relative to the back sides 613 of the upper rods 61. Preferably, the distance between the front and back sides 612, 622, 613, 623 of the upper and lower rods 61, 62 is equal to the radius of each of the circular connecting portions 63. Each of the circular connecting portions 63 has a first circumferential edge section 631, a second circumferential edge section 632 diametrically opposite to the first circumferential edge section 631, a third circumferential edge section 633 between the first and second circumferential edge sections 631, 632 and disposed adjacent to the upper end of a respective one of the lower rods 62, and a fourth circumferential edge section 634 which is diametrically opposite to the third circumferential edge section 633 and which is disposed adjacent to the lower end of a respective one of the upper rods 61. The first circumferential edge section 631 forms a first shoulder that interconnects the front side 612 of one of the upper rods 61 and the front side 622 of a corresponding one of the lower rods 62. The second circumferential edge section 632 forms a second shoulder that interconnects the back side 613 of one of the upper rods 61 and the back side 623 of a corresponding one of the lower rods 62. The upper end of each of the lower rods 62 has a concave first end face 621 which extends transversely along the third circumferential edge section 633 at the inner side of a corresponding one of the circular connecting portions 63. The lower end of each of the upper rods 61 has a concave second end face 611 which extends transversely along the fourth circumferential edge section 634 at the inner side of a corresponding one of the circular connecting portions 63.

The first support lever 60 is further formed with a transverse first slide shaft 65 which interconnects lower ends of the lower rods 62 and which extends into the first slide recess 34 of the base plate 30 for slidable retention therein so as to engage slidably the lower portion of the first support lever 60 within the first slot retainer unit of the base plate 30. The upper portion of the first support lever 60 is further provided with an opposite pair of first pivot shafts 64 which extend outwardly and respectively from upper ends of the upper rods 61 and which are retained pivotally in the second pivot recesses 811 of the key cap 80.

The second support lever 70 has a symmetric construction and includes a parallel pair of lower arms 72 which serve as a lower portion of the second support lever 70, a parallel pair of upper arms 71 which serve as an upper portion of the second support lever 70, and a pair of circular plates 73 which interconnect upper ends of the lower arms 72 and lower ends of the upper arms 71 and which serve as an intermediate portion of the second support lever 71. In this embodiment, each of the circular plates 73 has a thickness equal to one half of the thickness of the upper and lower arms 71, 72, the upper and lower arms 71, 72 being equal in thickness to the upper and lower rods 61, 62 of the first support lever 60. The circular plates 73 have inner sides that are flush with inner sides of the upper and lower arms 71, 72, and outer sides that are indented relative to outer sides of the upper and lower arms 71, 72. Each of the upper arms 71 has a front side 712 and a back side 713. Each of the lower arms 72 has a front side 722 and a back side 723. Preferably, the distance between the front and back sides 712, 722, 713, 723 of the upper and lower arms 71, 72 is equal to the distance between the front and back sides 612, 622, 613, 623 of the upper and lower rods 61, 62 of the first support lever 60 and to the radius of each of the circular plates 73. The front sides 712 of the upper arms 71 protrude forwardly relative to the front sides 722 of the lower arms 72. The back sides 723 of the lower arms 72 protrude rearwardly relative to the back sides 713 of the upper arms 71. Each of the circular plates 73 has a first peripheral edge section 732, a second peripheral edge section 731 diametrically opposite to the first peripheral edge section 732, a third peripheral edge section 733 between the first and second peripheral edge sections 732, 731 and disposed adjacent to the lower end of a respective one of the upper arms 71, and a fourth peripheral edge section 734 which is diametrically opposite to the third peripheral edge section 733 and which is disposed adjacent to the upper end of a respective one of the lower rods 72. The first peripheral edge section 732 forms a third shoulder that interconnects the back side 713 of one of the upper arms 71 and the back side 723 of a corresponding one of the lower arms 72. The second peripheral edge section 731 forms a fourth shoulder that interconnects the front side 712 of one of the upper arms 71 and the front side 722 of a corresponding one of the lower arms 72. The lower end of each of the upper arms 71 has a concave third end face 711 which extends transversely along the third peripheral edge section 733 at an outer side of a corresponding one of the circular plates 73. The upper end of each of the lower arms 72 has a concave fourth end face 721 which extends transversely along the fourth peripheral edge section 734 at the outer side of a corresponding one of the circular plates 73. The third and fourth end faces 711, 721 of the circular plates 73 of the second support lever 70 abut slidably against the first and second shoulders, i.e., the first and second circumferential edge sections 631, 632 of the circular connecting portions 63 of the first support lever 60. The third and fourth shoulders, i.e., the first and second peripheral edge sections 732, 731 of the circular plates 73 of the second support lever 70, abut slidably against the first and second end faces 621, 611 of the first support lever 60. The outer sides of the circular plates 73 of the second support lever 70 abut slidably against the inner sides of the circular connecting portions 63 of the first support lever 60. In this manner, the first and second support levers 60, 70 are coupled rotatably to each other and are rotatable relative to one another about the aligned circular connecting portions 63 and the circular plates 73.

The lower portion of the second support lever 70 is formed with a pair of second pivot shafts 74 which extend transversely and inwardly from lower ends of the lower arms 72 and which are forced between the guiding strip 32 and the cantilevers 33 via the converging entrances 335 (see FIG. 4) for pivotal retention thereat. The upper portion of the second support lever 70 is formed with a pair of second slide shafts 75, which extend transversely and outwardly from upper ends of the upper arms 71, and which are guided by the inclined guiding faces 821 at the bottom side of the key cap 80 into the second slide recesses 822 for slidable retention thereat. The upper portion of the second support lever 70 is further formed with a transverse bridging rod 77 which interconnects the upper arms 71.

Figure 4:
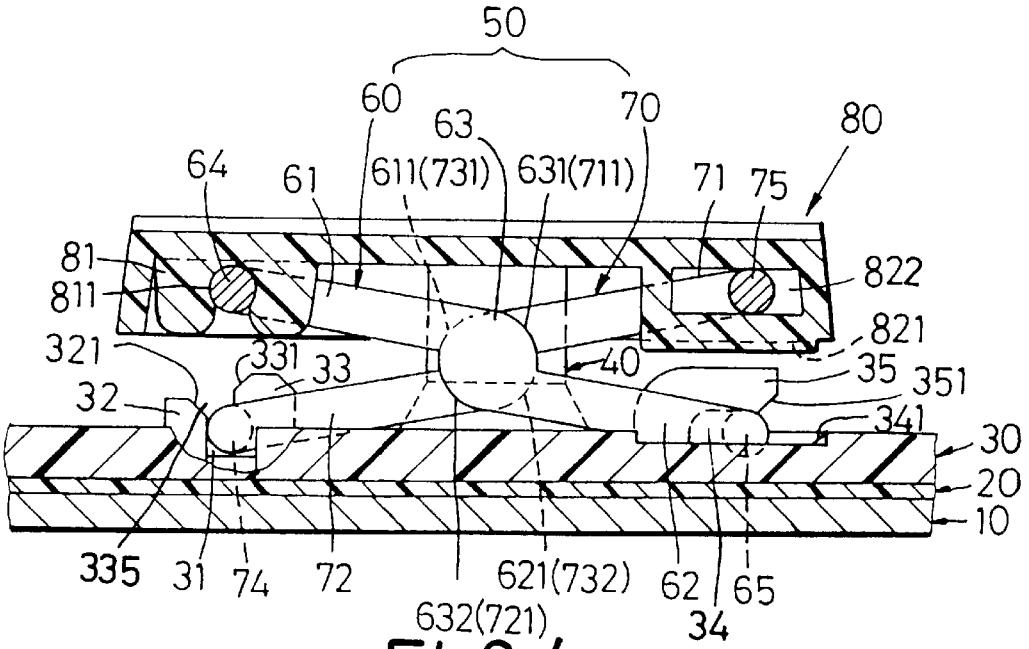
FIG. 4 is a schematic cross-sectional view of the key switch assembly of the preferred embodiment when a key cap thereof is in a non-depressed state, taken along line IV—IV in FIG. 3.

Referring to FIGS. 1 and 4, the biasing member 40 extends upwardly through the key cap support 50 between the circular connecting portions 63 of the first support lever 60, and between the circular plates 73 of the second support lever 70, and has a top end which abuts against the bottom side of the key cap 80 to bias the key cap 80 upwardly away from the base plate 30. The key cap 80 is depressible to compress the biasing member 40 and enable the membrane circuit 20 to produce an electrical signal.

Figure 3:
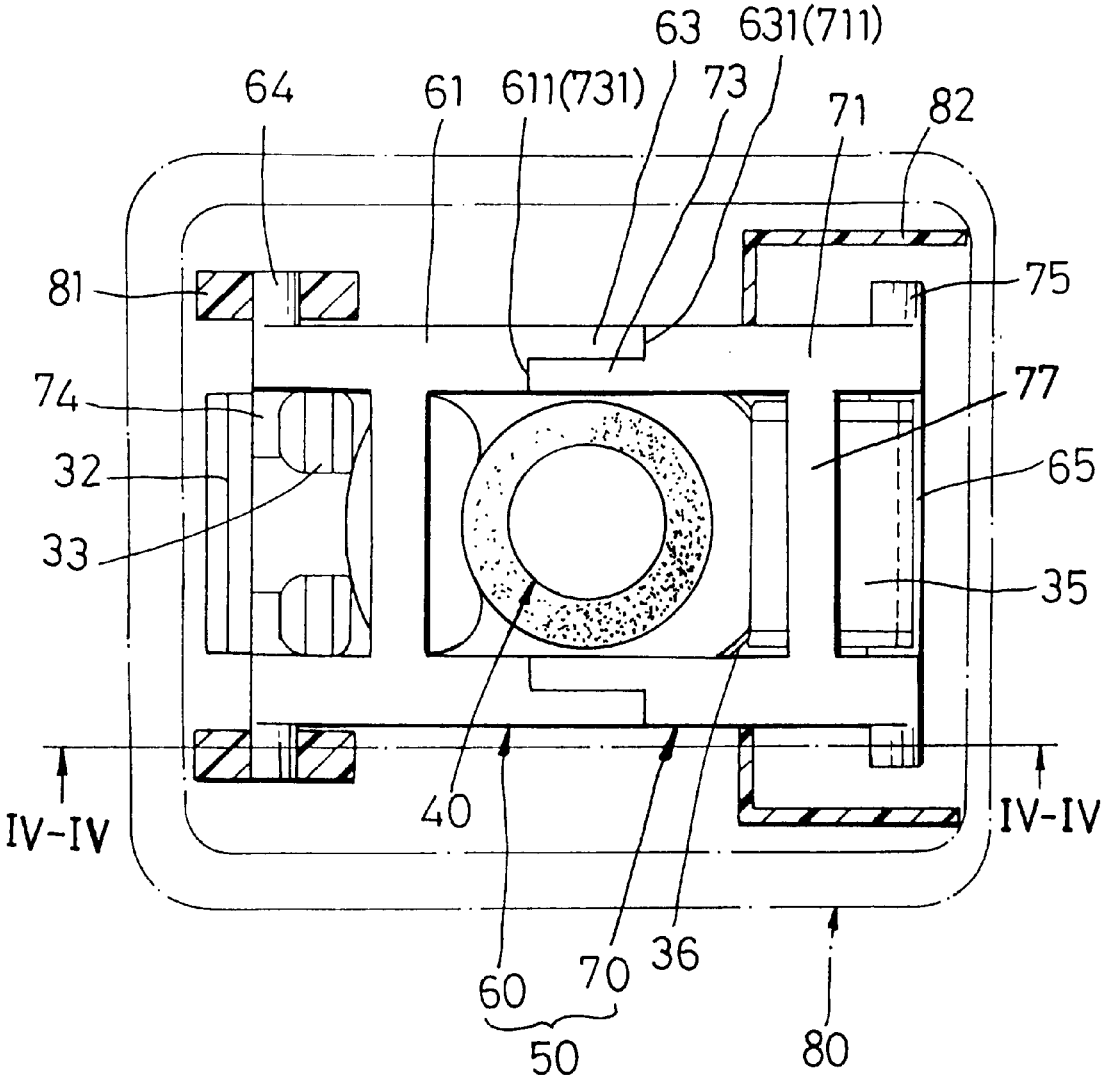
FIG. 3 is a top cross-sectional view of the key switch assembly of the preferred embodiment.

Referring to FIGS. 1 to 3, the key cap support 50 can be easily assembled by bending the lower arms 72 of the second support lever 70 inwardly and slightly and by extending the same downwardly between the pair of upper rods 61 of the first support lever 60 such that the circular plates 73 are disposed between and are registered with the circular connecting portions 63. In this situation, the first and second shoulders, i.e., the first and second circumferential edge sections 631, 632, of the circular connecting portions 63 of the first support lever 60 abut slidably against the third and fourth end faces 711, 721 of the circular plates 73 of the second support lever 70. The first and second end faces 621, 611 abut slidably against the third and fourth shoulders, i.e., the first and second peripheral edge sections 732, 731 of the circular plates 73 of the second support lever 70. The outer sides of the circular plates 73 of the second support lever 70 abut slidably against the inner sides of the circular connecting portions 63 of the first support lever 60. The first and second support levers 60, 70 are thus coupled rotatably to each other and are rotatable relative to one another about the axis of the aligned circular connecting portions 63 and circular plates 73.

Assembly of the key cap support 50 to the remaining parts of the key switch assembly can be conducted in a conventional manner. The key cap support 50 is disposed above the base plate 30 and below the key cap 80. The pair of second pivot shafts 74 of the second support lever 70 are forced resiliently into the pair of first pivot recesses 31 of the base plate 30 via the converging entrances 335 (see FIG. 4) for pivotal retention in the first pivot retainer unit of the base plate 30. The first slide shaft 65 of the first support lever 60 is extended between the inclined face 341 and the inclined end face 351 and into the first slide recess 34 for slidable retention in the first slot retainer unit of the base plate 30. The key cap 80 is then assembled to the key cap support 50 and the base plate 30 by press fitting the first pivot shafts 64 of the first support lever 60 into the second pivot recesses 811 of the key cap 80, and by forcing the second slide shafts 75 of the second support lever 70 into the second slide recesses 822 with the assistance of the inclined guiding faces 821. Finally, the biasing member 40 is extended upwardly through the opening 36 of the base plate 30 and through the first and second support levers 60, 70 to abut against the bottom side of the key cap 80. The membrane circuit 20 and the base board 10 are mounted to the base plate 30 to complete the key switch assembly.

After assembly, the key cap 80 is normally biased upwardly by the biasing member 40 so that the key cap support 50 forms a cross-shaped construction as shown in FIG. 4, thereby supporting the key cap 80 in a non-depressed state.

Figure 5:
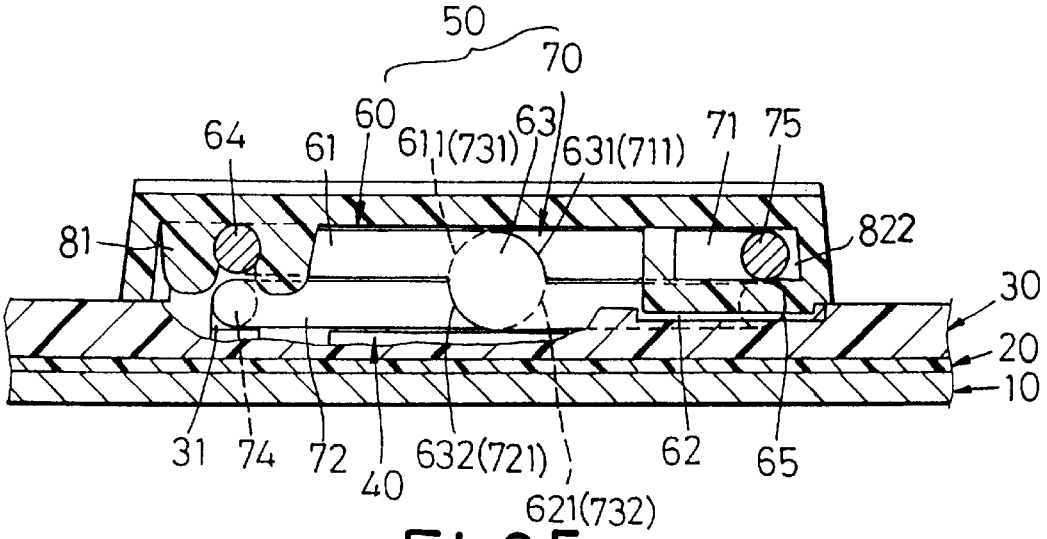
FIG. 5 is a schematic cross-section view of the key switch assembly of the preferred embodiment when the key cap is in a fully-depressed state, taken along line IV—IV in FIG. 3.

Referring to FIG. 5, when the key cap 80 is depressed, the biasing member 40 is compressed. The first and second support levers 60, 70 rotate about a pivot axis, i.e, the aligned circular connecting portions 63 and the circular plates 73, and the first and second slide shafts 65, 75 slide horizontally and longitudinally in the first and second slot retainer units of the base plate 30 and the key cap 80, respectively. The upper rods 61 are thus moved closer to the lower arms 72, and the lower rods 62 are moved closer to the upper arms 71. The key cap 80 can thus reach a fully-depressed state.

Accordingly, when the key switch assembly of the present invention is used in a notebook computer instead of the aforementioned conventional key switch assembly, the pivot axis of the key cap support 50, i.e., the circular connecting portions 63 and the circular plates 73, may be formed to have a diameter of up to 1.6 millimeter, which is much larger than the 1 millimeter diameters of the pins and pin holes in the conventional key switch assembly. The coupling strength between the first and second support levers 60, 70 can be raised significantly. In addition, the key cap support 50 of the key switch assembly of the present invention is easier to assemble because there is no need to register the small pins with the relatively small pin holes as taught in the conventional key switch assembly. The object of the present invention is thus met.

With this invention thus explained, it is apparent that numerous modifications and variations can be made without departing from the scope and spirit of this invention. It is therefore intended that this invention be limited only as indicated in the appended claims.

I claim:

1. A key switch assembly for a computer keyboard, said key switch assembly comprising:

a base board;

a membrane circuit provided on said base board, said membrane circuit having an electrical contact;

an upright biasing member supported on said membrane circuit;

a base plate disposed on said membrane circuit and formed with an opening to permit extension of said biasing member therethrough, said opening having opposite first and second sides, said base plate being further formed with a first slot retainer unit adjacent to said first side of said opening, and a first pivot retainer unit adjacent to said second side of said opening;

a scissors-type key cap support including first and second support levers with upper and lower portions, and intermediate portions that are coupled rotatably about a pivot axis, said lower portion of said first support lever being retained slidably in said first slot retainer unit of said base plate, said lower portion of said second support lever being retained pivotally in said first pivot retainer unit of said base plate; and a key cap having a bottom side formed with a second pivot retainer unit for retaining pivotally said upper portion of said first support lever, and a second slot retainer unit for retaining slidably said upper portion of said second support lever;

said first support lever having a generally rectangular frame section with a parallel pair of upper rods that serve as said upper portion of said first support lever and that have front and back sides and lower ends, a parallel pair of lower rods that serve as said lower portion of said first support lever and that have front and back sides and upper ends, and a pair of circular connecting portions that interconnect said lower ends of said upper rods and said upper ends of said lower rods and that serve as said intermediate portion of said first support lever, said front sides of said upper rods protruding forwardly relative to said front sides of said lower rods, said back sides of said lower rods protruding rearwardly relative to said back sides of said upper rods, each of said circular connecting portions having inner and outer sides, a first circumferential edge section which forms a first shoulder that interconnects said front sides of one of said upper rods and a corresponding one of said lower rods, a second circumferential edge section which is diametrically opposite to said first circumferential edge section and which forms a second shoulder that interconnects said back sides of one of said upper rods and a corresponding one of said lower rods, and a third circumferential edge section between said first and second circumferential edge sections and disposed adjacent to said upper end of a respective one of said lower rods, said upper end of each of said lower rods having a concave first end face which extends transversely along said third circumferential edge section at said inner side of a corresponding one of said circular connecting portions, each of said circular connecting portions further having a fourth circumferential edge section which is diametrically opposite to said third circumferential edge section and which is disposed adjacent to said lower end of a respective one of said upper rods, said lower end of each of said upper rods having a concave second end face which extends transversely along said fourth circumferential edge section at said inner side of a corresponding one of said circular connecting portions;

said second support lever having a parallel pair of lower arms that serve as said lower portion of said second support lever and that have front and back sides and upper ends, a parallel pair of upper arms that serve as said upper portion of said second support lever and that have front and back sides and lower ends, and a pair of circular plates that interconnect said upper ends of said lower arms and said lower ends of said upper arms and that serve as said intermediate portion of said second support lever, said front sides of said upper arms protruding forwardly relative to said front sides of said lower arms, said back sides of said lower arms protruding rearwardly relative to said back sides of said upper arms, each of said circular plates having inner and outer sides, a first peripheral edge section which forms a third shoulder that interconnects said back sides of one of said upper arms and a corresponding one of said lower arms, a second peripheral edge section which is diametrically opposite to said first peripheral edge section and which forms a fourth shoulder that interconnects said front sides of one of said upper arms and a corresponding one of said lower arms, and a third peripheral edge section between said first and second peripheral edge sections and disposed adjacent to said lower end of a respective one of said upper arms, said lower end of each of said upper arms having a concave third end face which extends transversely along said third peripheral edge section at said outer side of a corresponding one of said circular plates, each of said circular plates further having a fourth peripheral edge section which is diametrically opposite to said third peripheral edge section and which is disposed adjacent to said upper end of a respective one of said lower arms, said upper end of each of said lower arms having a concave fourth end face which extends transversely along said fourth peripheral edge section at said outer side of a corresponding one of said circular plates;

said first and second shoulders of said first support lever abutting slidably against said third and fourth end faces of said second support lever, and said first and second end faces of said first support lever abutting slidably against said third and fourth shoulders of said second support lever, thereby coupling rotatably said first and second support levers;

said biasing member extending upwardly through said key cap support between said circular connecting portions of said first support lever, and between said circular plates of said second support lever, and having a top end which abuts against said bottom side of said key cap to bias said key cap upwardly away from said base plate, said key cap being depressible to compress said biasing member and enable said membrane circuit to produce an electrical signal.

2. The key switch assembly according to claim 1, wherein said second support lever further has a transverse bridging rod interconnecting said upper arms.

* * * * *